United States Patent [19]

Flaig et al.

[11] Patent Number: 4,559,908

[45] Date of Patent: Dec. 24, 1985

[54] ENGINE BLOCK WITH UNITARILY CAST EXHAUST GAS PASSAGES AND WATER JACKET CAVITY

[75] Inventors: John D. Flaig, Libertyville, Ill.; Dale L. Taipale, Dalafield, Wis.

[73] Assignee: Outboard Marine Corporation, Waukegan, Ill.

[21] Appl. No.: 504,537

[22] Filed: Jun. 15, 1983

[51] Int. Cl.[4] ..... F01P 3/12

[52] U.S. Cl. ..... 123/41.28; 123/195 R; 123/65 PE; 60/323

[58] Field of Search ..... 123/195 R, 195 S, DIG. 8, 123/51 BD, 65 A, 41.28, 41.29, 41.72, 41.74, 41.75, 41.79, 41.81, 52 MC, 55 VE, 58 R, 65 EM, 65 P, 74 AE, 52 M, 52 MV, 65 PE; 60/321, 323; 164/34

[56] References Cited

U.S. PATENT DOCUMENTS

| | | | |
|---|---|---|---|
| 2,334,972 | 11/1943 | Wallgreen | 123/65 P |
| 2,740,393 | 4/1956 | Hoffman | 123/195 R |
| 2,810,378 | 10/1957 | Burch | 123/195 R |
| 2,867,201 | 1/1959 | Dolza et al. | 123/195 R |
| 2,975,778 | 3/1961 | Wilcox | 123/41.74 |
| 3,324,533 | 6/1967 | Watteau | 123/41.31 |
| 3,692,006 | 9/1972 | Miller et al. | 123/55 VE |
| 3,744,462 | 7/1973 | Herschmann et al. | 123/41.74 |
| 4,082,068 | 4/1978 | Hale | 123/41.29 |
| 4,092,956 | 6/1978 | List et al. | 123/41.74 |
| 4,175,503 | 11/1979 | Ernest | 123/55 VE |
| 4,184,462 | 1/1980 | Hale | 123/65 EM |
| 4,346,676 | 8/1982 | Tyner | 123/41.74 |

*Primary Examiner*—Craig R. Feinberg
*Assistant Examiner*—David A. Okonsky
*Attorney, Agent, or Firm*—Michael, Best & Friedrich

[57] ABSTRACT

Disclosed herein is a method of fabricating an integrally cast engine block including a plurality of cylinders, exhaust passage portions which respectively extend from the cylinders and which form portions of exhaust gas passages of equal length, and a water jacket cavity including respective water jacket cavity portions in encircling relation to the exhaust passage portions, which method comprises the steps of providing a mold cavity which defines the exterior surface of the block, locating one or more disposable cores in the mold cavity so as to provide for the exhaust passage portions and for the water jacket cavity, filling the mold cavity with molten metal to provide a unitarily cast engine block, permitting soldification of the block with the cores contained therein, and removing the disposable cores from within the engine block to provide the hollow exhaust passage portions and the water jacket cavity.

9 Claims, 12 Drawing Figures

ENGINE BLOCK WITH UNITARILY CAST EXHAUST GAS PASSAGES AND WATER JACKET CAVITY

BACKGROUND OF THE INVENTION

The invention relates generally to internal combustion engine blocks and, more particularly, to methods of casting such blocks.

In the past, it has been conventional to cast an engine block with integrally cast cylinders and with wall portions of an exhaust system and a water jacket. The exhaust system was completed by connecting to the block one or more exhaust manifold covers. The water jacket was completed by connecting to the engine block and/or manifold covers one or more water jacket cover. This arrangement has been particularly used in connection with the manufacture of multi-cylinder engines having equal length exhaust passages, as disclosed, for instance, in the Miller U.S. Pat. No. 3,692,006, issued Sept. 19, 1972.

In some engines, a portion of the exhaust system has been integrally cast into a block along the sides of the cylinders by using disposable cores. Such arrangements did not provide for equal length exhaust gas passages and also did not provide for encircling of the exhaust gas passages with a water jacket.

In another prior construction, disposable cores have been employed to provide integrally cast exhaust passages, but no provision was made for exhaust passages of equal length, or for an integrally cast water jacket encircling at least part of the exhaust gas passages.

Attention is also directed to U.S. Pat. No. 4,346,676 issued Aug. 31, 1982.

SUMMARY OF THE INVENTION

The invention provides a method of fabricating an integrally cast engine block including a plurality of cylinders, exhaust gas passage portions which respectively extend from and communicate with the cylinders, and a water jacket cavity including respective water jacket cavity portions in encircling relation to the exhaust gas passage portions, which method comprises the steps of providing a mold cavity which defines the exterior surface of the block, the exhaust gas passage portions, and the water jacket cavity including the water jacket portions in encircling relation to the exhaust gas passage portions, filling the mold cavity with molten metal to provide a unitarily cast engine block, and permitting solidification of the block to thereby provide the hollow exhaust passage portions and the water jacket cavity including the portions in encircling relation to each of the exhaust gas passage portions.

The invention also provides a method of fabricating an integrally cast engine block including a plurality of cylinders, exhaust gas passage portions which respectively extend from and communicate with the cylinders, and a water jacket cavity including respective water jacket cavity portions in encircling relation to each of the exhaust gas passage portions, which method comprises the steps of providing a mold cavity which determines the exterior surface of the block, locating one or more disposable cores in the mold cavity so as to provide the exhaust gas passage portions and the water jacket cavity, filling the mold cavity with molten metal to provide a unitarily cast engine block, permitting solidification of the block with the disposable cores contained therein, and removing the disposable cores from within the engine block to provide hollow exhaust passage portions and a hollow water jacket cavity.

In one embodiment of the invention, the exhaust gas passage portions form portions of exhaust gas passages of equal length.

The invention also provides an engine block comprising an integrally cast component including an exterior surface, which component also includes integrally cast first wall means defining a plurality of cylinders in parallel relation to each other, which component also includes integrally cast second wall means defining a plurality of exhaust gas passage portions respectively extending from and comunicating with said plurality of cylinders, which plurality of exhaust gas passage portions communicates with the exterior surface and is imperforate and smooth walled between the exterior surface and the cylinders, and which component also includes integrally cast third wall means defining a coolant jacket cavity extending within the component and located inwardly of the exterior surface and having inlet and outlet openings in the exterior surface, which water jacket cavity encircles the cylinders and includes a plurality of portions respectively encircling the plurality of exhaust gas passage portions in the area immediately adjacent to the communication of the exhaust gas passage portions with the cylinders.

The invention also provides an engine block comprising an integrally cast component including two cylinder banks extending in acute relation to each other, each bank including first wall means defining a series of first, second, third and fourth cylinders having respective axes in parallel relation to each other, which integrally cast component also includes an exterior surface including for each cylinder bank, a cylinder head surface portion, a surface portion partailly defining a crankcase having a crankcase axis extending in generally perpendicular relation to said cylinder axes, and an end wall surface portion located in generally perpendicular relation to the crankcase axis, which end wall surface portion includes first and second exhaust gas outlets located in generally radially aligned relation to each other with respect to the crankcase axis, which second exhaust gas outlet is located more remotely from the crankcase defining surface portion than the first exhaust gas outlet, which component also includes integrally cast second wall means defining an exhaust gas passage system including, for each cylinder bank, first, second, third and fourth exhaust gas passage portions extending respectively from and communicating with the first, second, third and fourth cylinders, which first and second exhaust gas passage portions merge at a first point into a first common exhaust gas passageway which communicates with the first exhaust gas outlet, which first and second exhaust gas passage portions and the first common exhaust gas passageway are imperforate and smooth walled and which first and second exhaust gas passage portions have equal effective distances from the first merge point to the first and second cylinders in each of the cylinder banks, which third and fourth exhaust gas passage portions merge at a second point into a second common exhaust gas passageway communicating with the second exhaust gas outlet, which third and fourth exhaust gas passage portions and the second common exhaust gas passageway are imperforate and smoothed walled and which third and fourth exhaust gas passage portions have equal effective distances from the second merge point to the third and fourth cylinders in each of the cylinder banks, which first and second common exhaust gas passageways each have a cross-section and a length such that the effective distance from the first exhaust gas outlet to the first and second cylinders in each of the cylinder banks is the same as the effective distance from the second exhaust gas outlet to the third and fourth cylinders in each of the cylinder banks, and which component also includes integrally cast third wall means defining a coolant jacket cavity extending within the component and located inwardly of the exterior surface and having inlet and outlet openings in the exterior surface and openings in the head surface portions of the cylinder banks, which water jacket cavity encircles the cylinders and the first and second exhaust gas passageways and includes first, second, third and fourth portions encircling the first, second, third, and fourth exhaust gas passage portions in the area immediately adjacent to the communication of the first, second, third and fourth exhaust gas passage portions with the cylinders.

Other features and advantages of the embodiments of the invention will become known by reference to the following general description, claims, and appended drawings.

IN THE DRAWINGS

Figure 1:
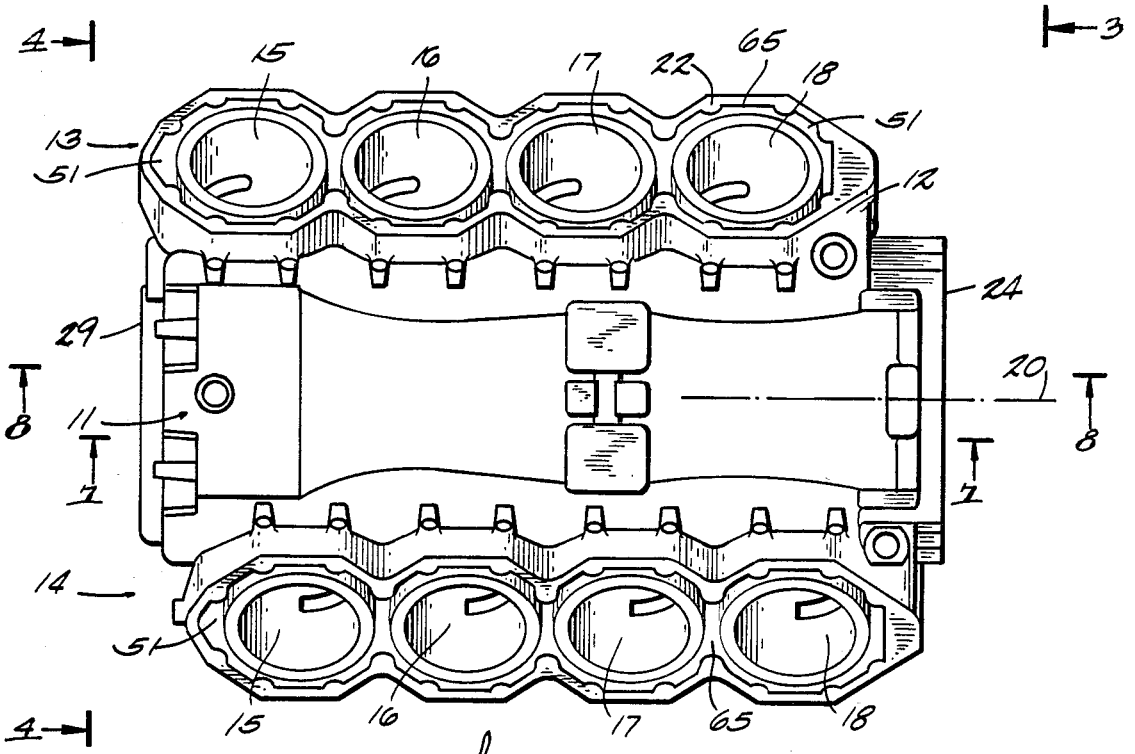
FIG. 1 is a top plan view of an engine block component which embodies various of the features of the invention and which has been fabricated in accordance with a method of the invention.
Figure 2:
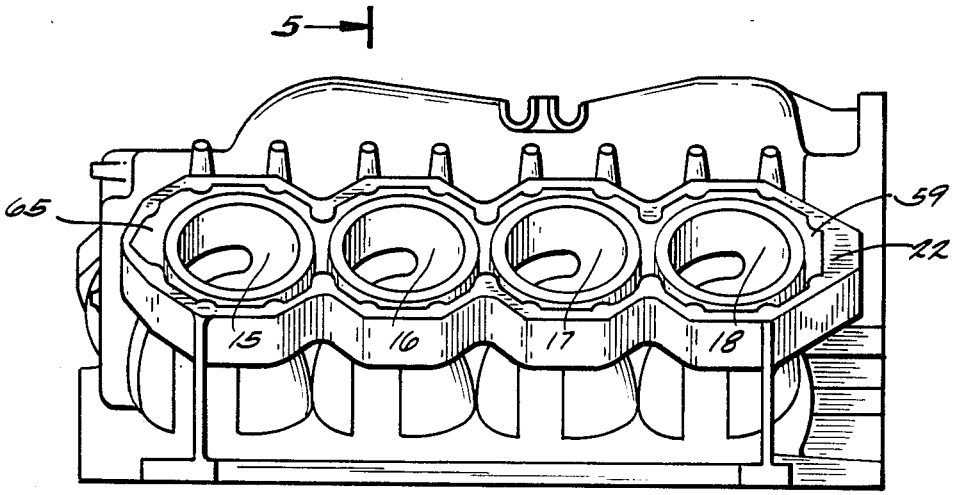
FIG. 2 is a side elevational view of the engine block component shown in FIG. 1.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 3:
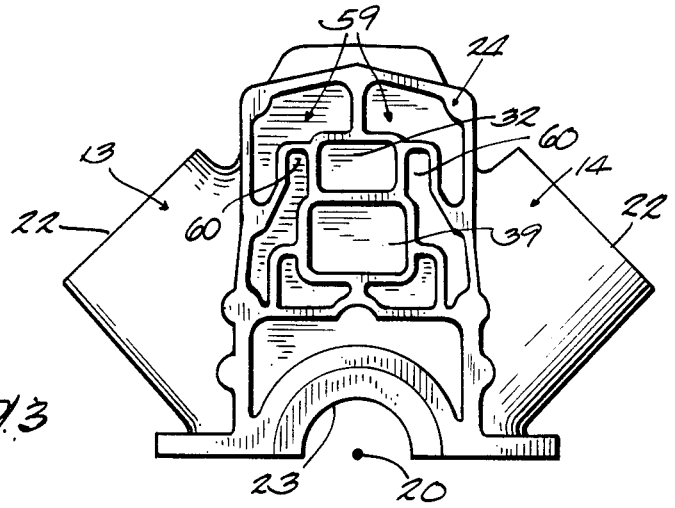
FIG. 3 is an end elevational view of one end of the engine block component shown in FIGS. 1 and 2, which end is the bottom end in usage.
Figure 4:
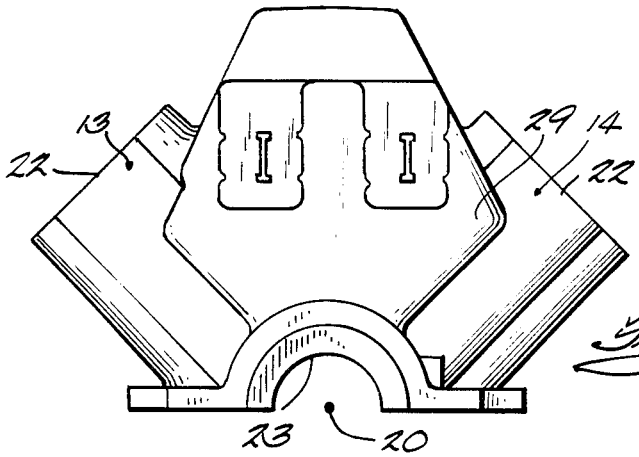
FIG. 4 is another end elevational view of the engine block component shown in FIGS. 1 and 2.
Figure 5:
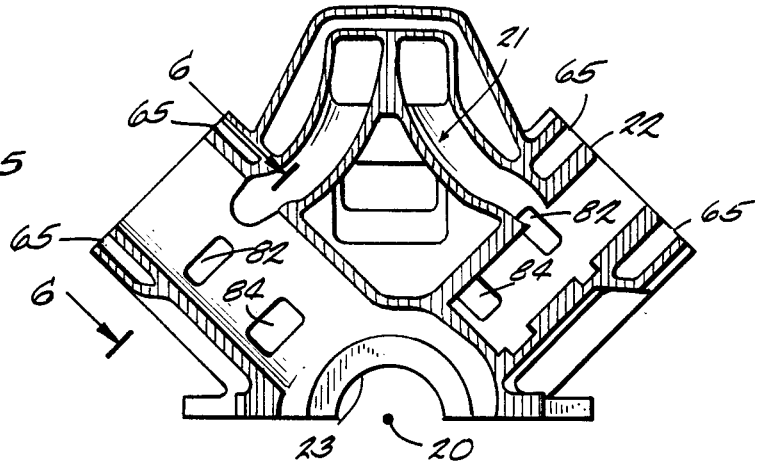
FIG. 5 is a sectional view taken along line 5—5 of FIG. 2.

Shown schematically in the drawings is a unitarily cast engine block component 11 which is of V-type and which includes an outer or exterior surface 12 and, interiorly, a plurality of cylinders. In the disclosed construction, the block 11 includes two cylinder banks 13 and 14 extending (See FIGS. 3, 4 and 5) in acute relation to each other relative to a crankcase axis 20. Each of the banks 13 and 14 includes integrally cast wall means defining four cylinders 15, 16, 17 and 18. While the disclosed block is of V-shape, the invention extends to all multi-cylinder blocks whether of in-line, opposed, or V constructions.

In the disclosed block, the exterior surface 12 incudes, for each of the cylinder banks 13 and 14, (see FIGS. 1, 3 and 4) a cylinder head surface portion 22. In addition, the exterior surface 12 includes (see FIGS. 3, 4 and 5) a surface portion 23 which partially defines a crankcase extending around the crankcase axis 20. Still further in addition, the exterior surface 12 includes (see FIGS. 1 and 3) an end wall or surface portion 24 which extends generally perpendicularly to the crankcase axis 20 and which is the bottom wall when the block is used, for instance, in an outboard motor. Still further, the exterior surface 12 includes (see FIGS. 1 and 4) an end wall or surface portion 29 which constitutes the top wall when the block is used in an outboard motor.

Extending from the cylinders 15, 16, 17 and 18 in each bank is integrally cast wall means defining (see FIG. 5) an exhaust system 21 including (see FIG. 6) respective unitarily cast exhaust passage portions 25, 26, 27 and 28 which, in each of the banks 13 and 14, respectively extend from and communicate with the cylinders 15, 16, 17 and 18 and which are designed to be of equal length to a common junction or merge point which can be located exteriorly of or within the block 11. In the preferred and disclosed construction, the exhaust passage portions 25 and 26 merge, as indicated at 30 in FIG. 6, into a common portion or exhaust gas passageway 31 terminating (see FIG. 7) in an outlet 32 in the end wall or surface portion 24 of the exterior surface 12 of the engine block component 11, which outlet 32 can be communicated with other components of the engine to complete the exhaust system.

Thus, the outlet 32 serves the lower two cylinders in each bank 13 and 14, with the effective distances from the merge point 30 to the cylinder exhaust ports being equal.

Figure 6:
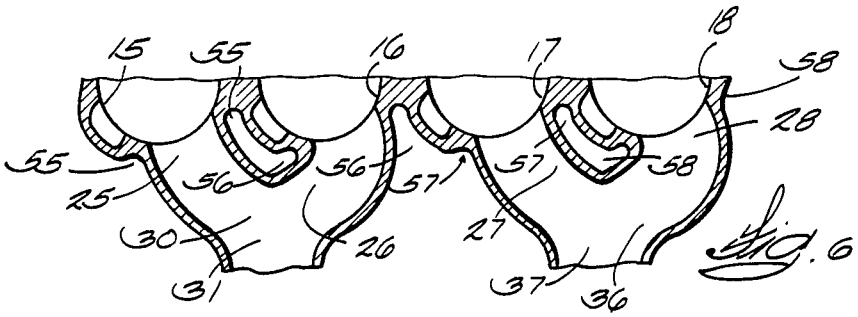
FIG. 6 is a fragmentary sectional view taken along the line 6—6 in FIG. 5.
Figure 7:
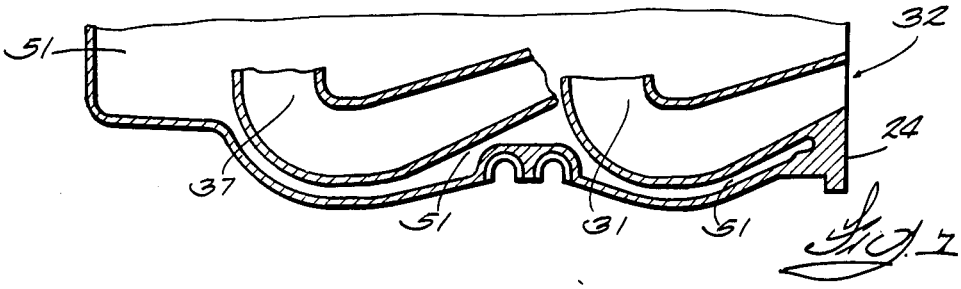
FIG. 7 is a fragmentary sectional view taken along line 7—7 of FIG. 1.
Figure 8:
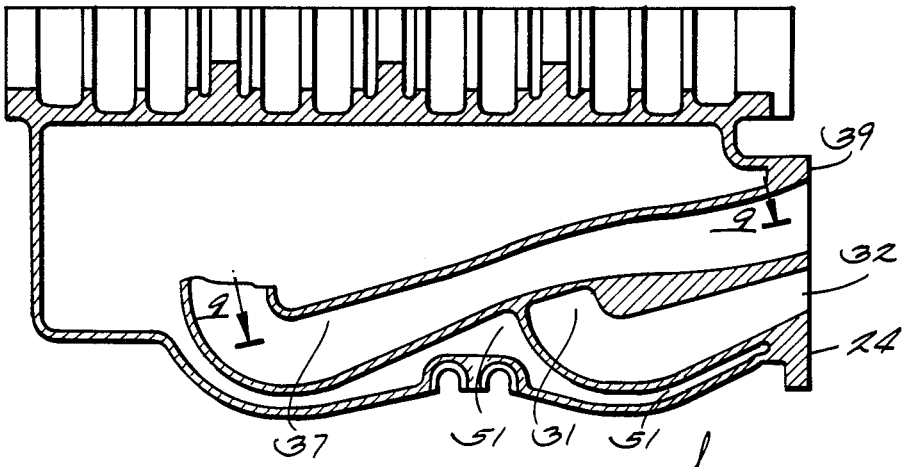
FIG. 8 is a sectional view taken along the line 8—8 of FIG. 1.
Figure 9:
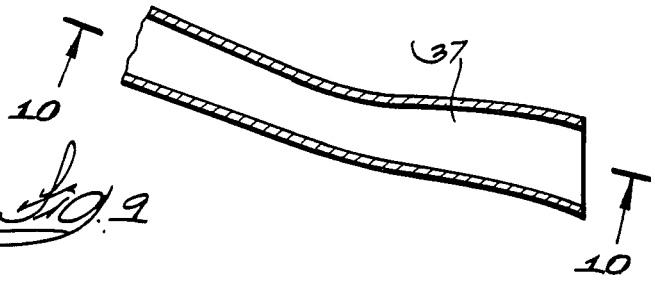
FIG. 9 is a fragmentary sectional view taken along line 9—9 of FIG. 8.
Figure 10:
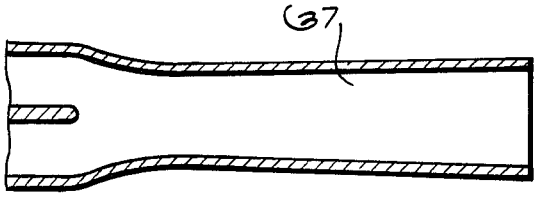
FIG. 10 is a fragmentary sectional view taken along line 10—10 of FIG. 9.
Figure 11:
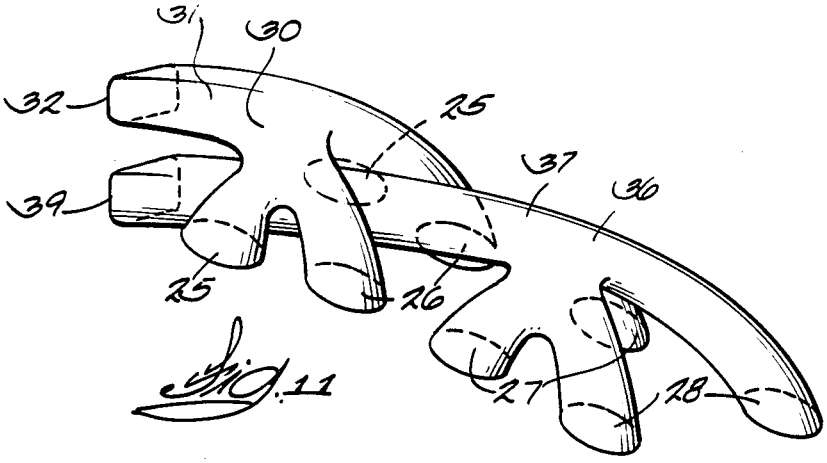
FIG. 11 is a schematic perspective view of the exhaust gas passage system included in the engine block component shown in FIGS. 1 and 2.

In addition, the exhaust passage portions 27 and 28 merge, as indicated at 36 in FIG. 6, into a common portion or exhaust gas passageway 37 terminating in an outlet 39 in the end wall or surface portion 24 of the exterior surface 12 of the engine block component 11, which outlet 39 can be communicated with other components of the engine to complete the exhaust system. The common outlet 39, when viewed in the direction from the center of the "V", i.e., from the crankcase axis 20, is located inwardly, i.e., toward the apice of the "V" relative to the outlet 32. Thus, the common outlet 37 is located radially outwardly from the common outlet 32 in the direction away from the apice of the "V" and serves the upper two cylinders 17 and 18 in each bank with the effective distances from the merge point 36 to the cylinder exhaust ports being equal.

The first and second common exhaust gas passageways 31 and 37 each have a cross-section and length such that the effective distance from the first exhaust gas outlet 32 to the first and second cylinders 15 and 16 in each of the cylinder banks 13 and 14 is the same as the effective distance from the second exhaust gas outlet 39 to the third and fourth cylinders 15 and 16 in each of the cylinder banks 13 and 14.

The term equal length or effective distance as used herein relates to the sizing of the exhaust gas passage portions 25, 26, 27 and 28 and the exhaust gas passageways 31 and 37 both with respect to length and cross-section, and any other factor which affects pressure wave travel, in such manner that acoustical pressure waves traveling therethrough experience equal time intervals for travel from the exhaust ports of the cylinders 15 and 16 to the merge point 30, from the exhaust ports of the cylinders 17 and 18 to the merge point 36, and from the exhaust ports of the cylinders 15, 16, 17 and 18 to the outlets 32 and 39.

Also unitarily cast in the engine block 11 is (see FIG. 1) wall means defining a water jacket cavity 51 which generally encircles the cylinders 15, 16, 17 and 18, as well as the exhaust gas passageways 31 and 37, and which includes respective portions 55, 56, 57 and 58 which respectively completely encircle each of the exhaust passage portions 25, 26, 27 and 28. The water jacket cavity 51 also preferably includes (see FIG. 3) at least one inlet opening 59 and one outlet opening 60 in the end or bottom wall 24 of the engine block component 11 to afford connection thereto of water supply and drain connections. In addition, the water jacket cavity 51 includes (see FIGS. 1 and 5) openings 65 in the cylinder head surface portions 22, which openings are intended to afford coolant flow to a cylinder head cover (not shown).

Figure 12:
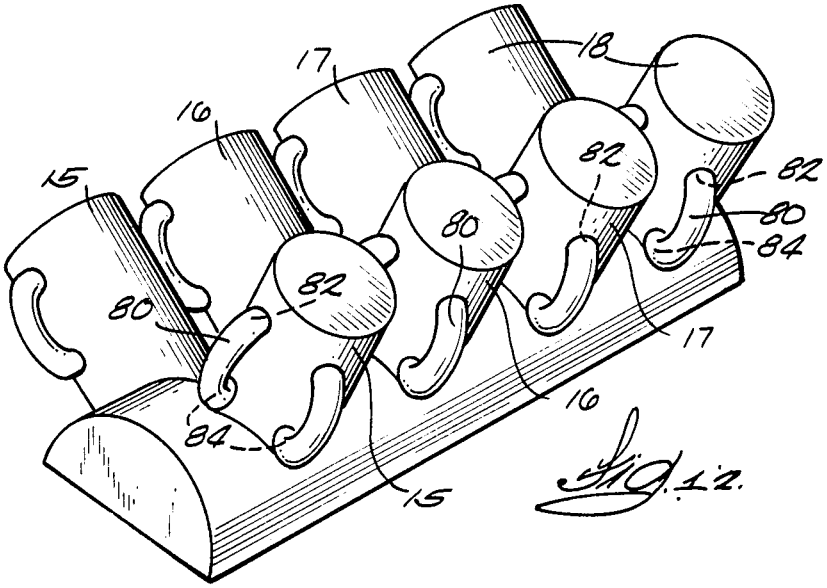
FIG. 12 is a schematic perspective view of the cavities found in the engine block component shown in FIGS. 1 and 2.

Also integrally cast into the engine block component 11 for each of the cylinders 15, 16, 17 and 18 are two transfer passages 80 which include (see FIG. 12) respective cylinder ports indicated at 82 and crankcase ports indicated at 84.

The unitary engine block component 11 thus includes, in a single unitary casting, at least portions of equal length exhaust gas passage portions extending from the cylinders 15, 16, 17 and 18 so as to obviate the prior employment of separate exhaust manifolds or covers. In addition, the single, unitarily cast block or component 11 includes the water jacket cavity 51 which encircles and therefore adequately cools the exhaust passage portions 25, 26, 27 and 28 and obviates the prior employment of separate water jacket covers.

The unitarily cast block component 11 can be cast by various methods including high pressure casting, i.e., die casting; low pressure casting, i.e., permanent mold casting; casting in sand having therein a mold cavity formed by a pattern which has been removed, i.e., sand casting; and lost pattern casting in sand having therein a pattern which vaporizes in response to exposure to molten metal.

As used in the claims, the term "mold cavity" refers to the cavity employed in high and low pressure casting, to the cavity formed by removing the pattern in sand casting, and to the cavity occupied by the vaporizable pattern in lost pattern casting. In effect, the term mold cavity refers to the cavity which is eventually occupied by metal.

The unitarily cast engine block component 11 is obtained by a method which comprises providing a mold cavity which defines the exterior surface of the block, the exhaust gas passage portions, and the water jacket cavity including the portions in encircling relation to each of the gas exhaust passage portions, filling the mold cavity with molten metal to provide the unitarily cast engine block, and permitting solidification of the block to thereby provide the hollow exhaust gas passage portions and the water jacket cavity including the portions in encircling relation to the exhaust gas passage portions.

The unitarily cast engine block component 11 is also obtained by a method which comprises the steps of providing a mold cavity which forms the external surface 12 of the engine block component 11, inserting or locating one or more disposable cores in the mold cavity so as to provide the cylinders 15, 16, 17 and 18, as well the hollow exhaust gas system 21 and the water jacket cavity 51, pouring molten metal into the mold cavity to unitarily cast the engine block component 11, permitting solidification of the block or component 11 with the cores contained therein, removing the cast block or component 11 from the mold cavity, and evacuating the core material from the interior of the unitarily cast engine block component 11 to provide the cylinders 15, 16, 17 and 18, the exhaust gas passage system 21 including the hollow exhaust gas system passage portions 25, 26, 27, and 28, and the exhaust gas passageways 31 and 37 and the water jacket cavity 51.

The casting of a unitary engine block component 11 by die casting, by permanent mold casting, and by sand casting, is faciliatated by the use of rupturable or disposable cores (not shown) which can be fabricated of suitable salt or sand from processes which do not form a part of the invention. The casting of a unitary engine block component 11 by lost pattern casting is facilitated by a vaporizeable pattern which can include vaporizeable cores.

The engine block as a whole is completed by a crankcase cover (not shown) which forms the bottom half of the crankcase and which serves to complete the crankcase and by respective cylinder bank covers (not shown) which provide heads for the cylinders 15, 16, 17 and 18.

It is particularly noted that the resulting engine block component includes uninterrupted smooth wall exhaust gas passages 31 and 37 and passage portions 25, 26, 27 and 28 which reduce impedence to exiting gas flow and thereby afford greater power development.

It is also noted that the water jacket cavity 51 completely encircles the exhaust gas passage system 21, and particularly, the portions 25, 26, 27 and 28 in the area adjacent to the cylinders 15, 16, 17 and 18, thereby providing for cooler engine operation and providing greater power development and thereby also eliminating exhaust gas manifolds and gaskets. In addition, the employment of an integrally cast internal water jacket cavity 51 eliminates the use of gaskets and covers to seal and complete the water jacket. Still further in addition, expensive machining of mating gasket surfaces is also eliminated.

Futhermore, the resulting engine block component 11 is structually stronger because the elimination of manifold and water jacket covers avoids the imposition of stresses occasioned by tightening the connections between the block component and the manifolds and/or covers. Still further, it is noted that the disclosed block component 11 is basically a box beam and the beam can readily be designed to provide strength where most desirable.

It is also noted that, during casting, the crankshaft axis 20 of the disclosed engine block component is horizontal.

Various of the features of the invention are set forth in the following claims.

We claim:

1. A method of fabricating an integrally cast engine block including a plurality of cylinders, exhaust gas passages respectively including passage portions which respectively extend from and communicate with the cylinders, and wall portions in spaced opposed relation to the cylinders and the exhaust gas passages and defining a water jacket cavity including respective water jacket cavity portions encircling the exhaust gas passage portions in the area immediately adjacent to the communication of the exhaust gas passage portions with the cylinders, said method comprising the steps of providing a mold cavity which defines the cylinders, the exhaust gas passages including the exhaust gas passage portions, and the wall portions which define the water jacket cavity including the water jacket portions encircling the exhaust gas portions in the area immediately adjacent to the communication of the exhaust gas passage portion with the cylinders, filling the mold cavity with molten metal to provide a unitarily cast engine block, and permitting solidification of the block to thereby provide the exhaust passage portions and the water jacket cavity including the portions encircling each of the exhaust gas passage portions in the area immediately adjacent to the communication of the exhaust gas passage portions with the cylinders.

2. A method in accordance with claim 1 wherein the exhaust gas passage portions form portions of exhaust gas passages of equal length.

3. A method of fabricating an integrally cast engine block including a plurality of cylinders, exhaust gas passages respectively including passage portions which respectively extend from and communicate with the cylinders, and wall portions in spaced opposed relation to the cylinders and the exhaust gas passages and defining a water jacket cavity including respective water jacket cavity portions in encircling relation to the exhaust gas passage portions in the area immediately adjacent to the communication of the exhaust gas passage portions with the cylinders, said method comprising the steps of providing a mold cavity which defines the exterior surface of the block and includes the wall portions in opposed spaced relation to the cylinders and the exhaust gas passages, locating one or more disposable cores in the mold cavity so as to provide for the exhaust gas passage portions and for the water jacket cavity including the water jacket portions in encircling relation to the exhaust gas passage portions in the area immediately adjacent to the communication of the exhaust gas passage portions with the cylinders, filling the mold cavity with molten metal to provide a unitarily cast engine block, permitting solidification of the block with the cores contained therein, and removing the disposable cores from within the engine block to provide the exhaust passage portions and the water jacket cavity including the portions in encircling relation to each of the exhaust gas passage portions in the area immediately adjacent to the communication of the exhaust gas passage portions with the cylinders.

4. A method in accordance with claim 3 wherein the exhaust gas passage portion form portions of exhaust gas passages of equal length.

5. An integrally cast engine block including an exterior surface, said block also including ingerally cast first wall means defining a plurality of cylinders in parallel relation to each other, said block also including second wall means integrally cast with said first wall means and defining a plurality of exhaust gas passages communicating with said exterior surface and respectively including portions respectively extending from and communicating with said plurality of cylinders, said plurality of exhaust gas passage portions being imperforate and smooth walled between said exterior surface and said cylinders, and said block also including third wall means integrally cast with said first and second wall means and including wall portions in spaced opposed relation to said first and second wall means to define a coolant jacket cavity extending within said block and located inwardly of said exterior surface and having inlet and outlet openings in said exterior surface, said water jacket cavity encircling said cylinders and said exhaust gas passages and including a plurality of coolant jacket portions respectively encircling said plurality of exhaust gas passage portions in the area immediately adjacent to the communication of said exhaust gas passage portions with said cylinders.

6. An integrally cast engine block including an exterior surface with a cylinder head surface portion, said block also including integrally cast first wall means defining a plurality of cylinders in parallel relaton to each other, said block also including second wall means integrally cast with said first wall means and defining a plurality of exhaust gas passages communicating with said exterior surface and respectively including passage portions respectively extending from and communicating with said plurality of cylinders, said plurality of exhaust gas passages being imperforate and smooth walled between said exterior surface and said cylinders, and said block also including third wall means integrally cast with said first and second wall means and including wall portions in spaced opposed relation to said first and second wall means to define a coolant jacket cavity extending within said block and located inwardly of said exterior surface and having inlet and outlet openings in said exterior surface and an opening in said cylinder head surface portion, and said water jacket cavity encircling said cylinders and said exhaust gas passages and including a plurality of coolant jacket portions respectively encircling said plurality of exhaust gas passage portions in the area immediately adjacent to the communication of said exhaust gas passage portions with said cylinders.

7. An integrally cast engine block including an exterior surface including a cylinder head surface portion, a surface portion partially defining a crankcase having a crankcase axis, and an end wall surface portion located in generally perpendicular relation to said crankcase axis, said end wall surface portion including first and second exhaust gas outlets located in generally radially aligned relation to each other with respect to said crankcase axis, said second exhaust gas outlet being located more remotely from said crankcase defining surface portion than said first exhaust gas outlet, said block also including integrally cast first wall means defining first, second, third and fourth cylinders in parallel relation to each other, said block also including second wall means integrally cast with said first wall means and defining an exhaust gas passage system including first, second, third and fourth exhaust gas passage portions extending respectively from and communicating with said first, second, third and fourth cylinders, said first and second exhaust gas passage portions merging at a first point into a first common exhaust gas passageway which communicates with said first exhaust gas outlet, said first and second exhaust gas passage portions and said first common exhaust gas passageway being imperforate and smooth walled and said first and second exhaust gas passage portions having equal effective distances from said first merge point to said first and second cylinders, said third and fourth exhaust gas passage portions merging at a second point into a second common exhaust gas passageway communicating with said second exhaust gas outlet, said third and fourth exhaust gas passage portions and said second common exhaust gas passageway being imperforate and smoothed walled and said third and fourth exhaust gas passage portions having equal effective distances from said second merge point to the third and fourth cylinder, said first and second common exhaust gas passageways each having a cross-section and a length such that the effective distance from said first exhaust gas outlet to said first and second cylinders is the same as the effective distance from said second exhaust gas outlet to said third and fourth cylinders, and said block also including third wall means integrally cast with said first and second wall means and including wall portions in spaced opposed relation to said first and second wall means to define a coolant jacket cavity extending within said block and located inwardly of said exterior surface and having inlet and outlet openings in said exterior surface and an opening in said head surface portion, said water jacket cavity encircling said cylinders and said first and second exhaust gas passageways and including first, second, third and fourth coolant jacket portions encircling said first, second, third, and fourth exhaust gas passage portions in the area immediately adjacent to the communication of said first, second, third and fourth exhaust gas passage portions with said cylinders.

8. An integrally cast engine block including two cylinder banks extending in acute relation to each other, each bank includes first wall means defining a series of first, second, third and fourth cylinders having respective axes in parallel relation to each other, said integrally cast block also including an exterior surface including for each cylinder bank, a cylinder head surface portion, a surface portion partially defining a crankcase having a crankcase axis extending in generally perpendicular relation to said cylinder axes, and an end wall surface portion located in generally perpendicular relation to said crankcase axis, said end wall surface portion including first and second exhaust gas outlets located in generally radially aligned relation to each other with respect to said crankcase axis, said second exhaust gas outlet being located more remotely from said crankcase defining surface portion than said first exhaust gas outlet, said block also including second wall means integrally cast with said first wall means and defining an exhaust gas passage system including, for each cylinder bank, first, second third and fourth exhaust gas passage portions extending respectively from and communicating with said first, second, third and fourth cylinders, said first and second exhaust gas passage portions merging at a first point into a first common exhaust gas passageway which communicates with said first exhaust gas outlet, said first and second exhaust gas passage portions and said first common exhaust gas passageway being imperforate and smooth walled and said first and second exhaust gas passage portions having equal effective distances from said first merge point to said first and second cylinders in each of said cylinder banks, said third and fourth exhaust gas passage portions merging at a second point into a second common exhaust gas passageway communicating with said second exhaust gas outlet, said third and fourth exhaust gas passage portions and said second common exhaust gas passageway being imperforate and smoothed walled and said third and fourth exhaust gas passage portions having equal effective distances from said second merge point to said third and fourth cylinders in each of said cylinder banks, said first and second common exhaust gas passageways each having a cross-section and a length such that the effective distance from said first exhaust gas outlet to said first and second cylinders in each of said cylinder banks is the same as the effective distance from said second exhaust gas outlet to said third and fourth cylinders in each of said cylinder banks, and said block also including third wall means integrally cast with said first and second wall means and including wall portions in spaced opposed relation to said first and second wall means to define a coolant jacket cavity extending within said block and located inwardly of said exterior surface and having inlet and outlet openings in said exterior surface and openings in said head surface portions of said cylinder banks, said water jacket cavity encircling said cylinders and said first and second exhaust gas passageways and including first, second, third and fourth coolant jacket portions encircling said first, second, third, and fourth exhaust gas passage portions in the area immediately adjacent to the communication of said first, second, third and fourth exhaust gas passage portions with said cylinders.

9. An integrally cast engine block including an exterior surface, said block also including integrally cast first wall means defining a plurality of cylinders in parallel relation to each other, said block also including second wall means integrally cast with said first wall means and defining a plurality of exhaust gas passages communicating with said exterior surface and respectively including portions respectively extending from and communicating with said plurality of cylinders, and said block also including third wall means integrally cast with said first and second wall means and including wall portions in spaced opposed relation to said first and second wall means to define a coolant jacket cavity extending within said block and located inwardly of said exterior surface and having inlet and outlet openings in said exterior surface, said water jacket cavity encircling said cylinders and said exhaust gas passages and including a plurality of coolant jacket portions respectively encircling said plurality of exhaust gas passage portions in the area immediately adjacent to the communication of said exhaust gas passage portions with said cylinders.

* * * * *